US006361377B1

(12) United States Patent
Saka et al.

(10) Patent No.: US 6,361,377 B1
(45) Date of Patent: Mar. 26, 2002

(54) TERMINAL FITTING, A CONNECTOR HOUSING AND A CONNECTOR COMPRISING THE SAME

(75) Inventors: Yukinori Saka; Masamitsu Chishima, both of Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/640,299

(22) Filed: Aug. 16, 2000

(30) Foreign Application Priority Data

Aug. 18, 1999 (JP) ..... 11-231878

(51) Int. Cl.[7] ..... H01R 13/434
(52) U.S. Cl. ..... 439/745
(58) Field of Search ..... 439/745, 748, 439/871, 744, 872, 873

(56) References Cited

U.S. PATENT DOCUMENTS

| | | | | |
|---|---|---|---|---|
| 5,803,756 A | * | 9/1998 | Furutani et al. | 439/188 |
| 5,826,152 A | * | 10/1998 | Suzuli et al. | 399/330 |
| 5,921,821 A | * | 7/1999 | Oka et al. | 439/845 |
| 5,951,314 A | * | 9/1999 | Durand-Cochet et al. | 439/252 |
| 5,951,338 A | | 9/1999 | Seko et al. | |
| 6,085,595 A | * | 7/2000 | Ferguson | 73/730 |

FOREIGN PATENT DOCUMENTS

| | | |
|---|---|---|
| DE | 43 42 820 | 6/1994 |
| DE | 197 02 373 | 8/1998 |
| DE | 197 47 115 | 4/1999 |

* cited by examiner

*Primary Examiner*—Gary Paumen
*Assistant Examiner*—Phuongchi Nguyen
(74) *Attorney, Agent, or Firm*—Anthony J. Casella; Gerald E. Hespos

(57) ABSTRACT

A terminal fitting (30) is provided for contact with a contact terminal (20) and for inverted insertion into a cavity (11). The terminal (30) has a cover (40) and a terminal main body (31). The cover (40) has a relatively high strength and is integrally secured to the terminal main body (31) in such a manner as to cover substantially entirely a connection portion (32). Cuts are made in opposite side walls of the cover (40) and the cut portions are bent to project outward to form elastically deformable metal locking portions (42). Openings (45) are provided in surfaces of the cover (40) adjacent to the side walls that have the metal locking portions (42). Contact portions (36) are provided on the connection portion (32) inside the cover (40) and can be brought into contact with a shorting terminal (20) that is exposed through the openings (45). The contact portions (36) and the metal locking portions (42) are displaced substantially by 90° from each other.

11 Claims, 6 Drawing Sheets

TERMINAL FITTING, A CONNECTOR HOUSING AND A CONNECTOR COMPRISING THE SAME

BACKGROUND OF THE INVENTION

1. Field of the Invention

The present invention relates to a terminal fitting that can be inserted into a cavity of a connector housing and that simultaneously can be brought into contact with a contact terminal facing a side wall of the cavity. Moreover, the invention relates to a connector housing and to a connector that comprises such connector housing and at least one such terminal fitting.

2. Description of the Related Art

Locking portions are formed on some prior art terminal fittings by cutting a section of the terminal fitting and bending the cut section. However the cutting of the above-described locking portion reduces the amount of metal plate material that is available to provide structural strength and rigidity for the terminal fitting. Some terminal fittings must be very small, and the cutting of the above-described locking portion may provide a terminal fitting that has insufficient strength. As a result, some prior art terminal fittings have a separate cover made of a stainless steel with a relatively high strength. The cover is fit on the leading end of the terminal fitting and a locking portion is formed on the cover. One such prior art terminal filling is disclosed in U.S. Pat. No. 5,951,338.

Some prior art terminal fittings of this type are used in connector housings while adjacent terminal fittings are shorted to each other. Specifically, a shorting terminal is provided outside two adjacent cavities, and contact portions of the shorting terminal face the inside of the two cavities through openings formed in a side wall of each cavity. Locking portions lock the terminal fittings during insertion into the terminal cavities, and contact portions of the shorting terminal engage portions of the respective terminal fittings behind the cover, thereby shorting the two terminal fittings to each other.

Many prior art terminal fittings must have a specific orientation for insertion into the cavities, and the requirement to orient the prior art terminal fittings has been cumbersome. To improve operator efficiency, terminal fittings that can be inserted upside down have been proposed. This technology conceivably could be applied to the above-described prior art terminal fittings by forming a pair of locking portions on upper and lower surfaces of the cover. Thus, one of the locking portions can engage a locking part in the cavity regardless of whether the terminal fitting is erect or inverted.

However, the terminal fitting also must contact the shorting terminal, and the unused locking portion in the pair of locking portions may be caught by the shorting terminal or the opening when the terminal fitting is inserted into and withdrawn from the cavity. Thus, a combination of the above-described locking, orientation and shorting functions cannot be accommodated easily.

In view of the above, an object of the present invention is to provide a terminal fitting, a connector housing and a connector, such that the terminal fitting can contact a contact terminal, and also can be inserted into a cavity while being held upside down.

SUMMARY OF THE INVENTION

The subject invention is directed to a terminal fitting that can be inserted at least partly into a cavity of a connector housing and that can be brought into contact with a contact terminal that faces a side wall of the cavity. The terminal fitting comprises at least one terminal side locking portion in a specified position on an outer surface of the terminal fitting. The terminal side locking portion is engageable with at least one cavity side locking portion in the cavity. The terminal fitting further comprises contact portions that can be brought into contact with the contact terminal. The contact portions are provided on surfaces of the terminal fitting that are displaced by an angle of preferably substantially 90° from the terminal side locking portion.

Preferably the terminal can be inserted and locked in the cavity either in an erect orientation or an inverted orientation by providing a pair of the cavity side locking portions and/or a pair of the terminal side locking portions.

As noted above, the terminal side locking portion and the contact portions that engage the contact terminal are displaced substantially by 90°. Additionally, the cavity side locking portion and the contact terminal also may be displaced substantially by 90°. Thus, if the terminal fitting is inserted into the cavity or withdrawn from the cavity of the connector housing in an erect or inverted orientation, the moving path of the terminal side locking portion is away from the position of the contact terminal. As a result, the terminal side locking portion is free from interference with the contact terminal.

The terminal fitting may comprise a cover and a terminal main body. The cover may be provided with the terminal side locking portion and may be fitted integrally on the terminal main body of the terminal fitting. The contact portions may be formed on the terminal main body, and the cover may be formed with openings for exposing the contact portions. More particularly, the contact portions may be formed to project outwardly on the terminal main body and into the openings of the cover. The terminal main body is to be connected with a mating terminal fitting.

The contact portions provided on the terminal main body are exposed through the openings of the cover, and can be brought into contact with the contact terminal. Thus, the cover does not impede the ability of the contact terminal to be brought directly into contact with the terminal main body for electrical connection.

These and other objects, features and advantages of the present invention will become apparent upon reading of the following detailed description of preferred embodiments and accompanying drawings.

DETAILED DESCRIPTION OF THE PREFERRED EMBODIMENT

Figure 1:
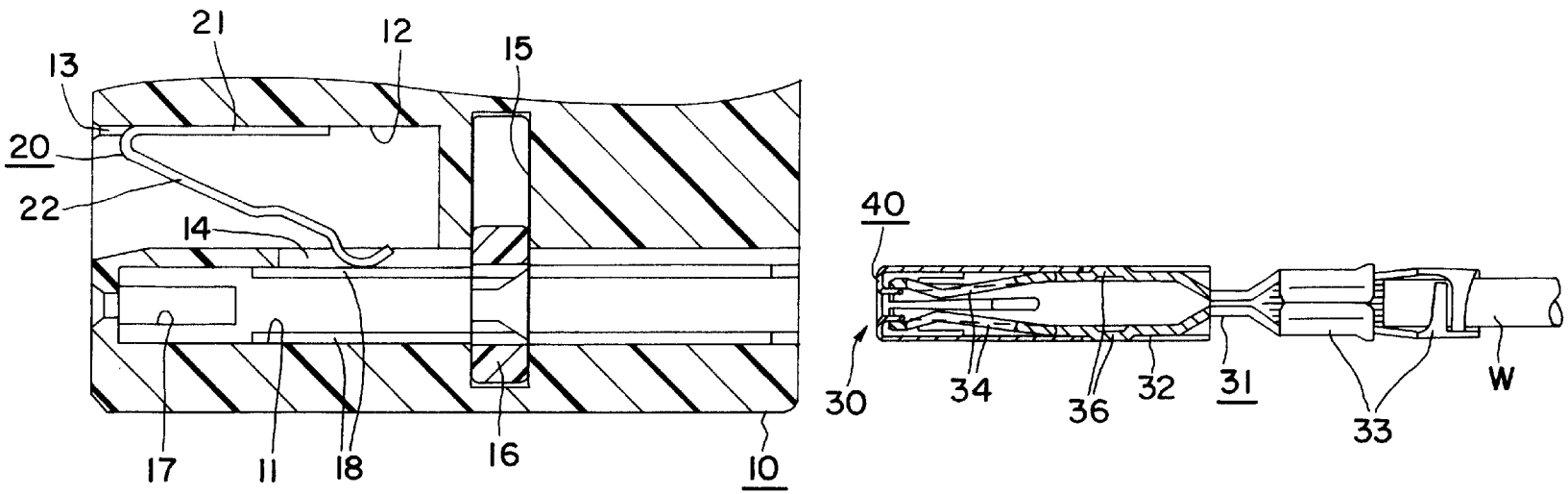
FIG. 1 is a side view in section showing a female housing before a female terminal fitting according to one embodiment of the invention is inserted.

A terminal fitting in accordance with the invention is identified generally by the numeral 30 in FIGS. 1 to 11. In this embodiment, a female terminal fitting 30 is shown. This female terminal fitting 30 can be brought into contact with a shorting terminal 20 while being at least partly accommodated in a female connector housing 10, as shown in FIG. 1.

The female housing 10 is formed with a plurality of cavities 11 for at least partly accommodating the female terminal fittings 30. In the illustrated embodiment, two cavities 11 are arranged substantially side by side, as shown most clearly in FIG. 3.

An accommodating chamber 12 is formed adjacent the cavities 11 and opens forwardly on the female housing 10. The accommodating chamber 12 is configured for at least partly accommodating the shorting terminal 20. Grooves 13 are provided at substantially opposite upper sides of the accommodating chamber 12, and the shorting terminal 20 can be mounted at least partly in the accommodating chamber 12 by inserting a flat base portion 21 of the shorting terminal 20 into the grooves 13.

The accommodating chamber 12 includes a bottom wall that separates the accommodating chamber 12 from the cavities 11. A portion of the bottom wall at the back of the accommodating chamber 12 is formed with openings 14 that communicate respectively with portions of the two cavities 11 located adjacent the accommodating chamber 12, as shown in FIG. 1.

Two substantially elastically deformable contact pieces 22 extend downward or toward the terminal fittings 30 from the base portion 21 of the shorting terminal 20. The contact pieces 22 can be introduced into the openings 14 and can be brought into contact with the female terminal fittings 30 in the respective cavities 11. More particularly, two adjacent female terminal fittings 30 can be shorted by bringing the contact pieces 22 of the shorting terminal 20 into contact with the female terminal fittings 30.

A mount groove 15 is provided behind the accommodating chamber 12 for mounting a retainer 16 that can lock the female terminal fittings 30 in the cavities 11.

Figure 2:
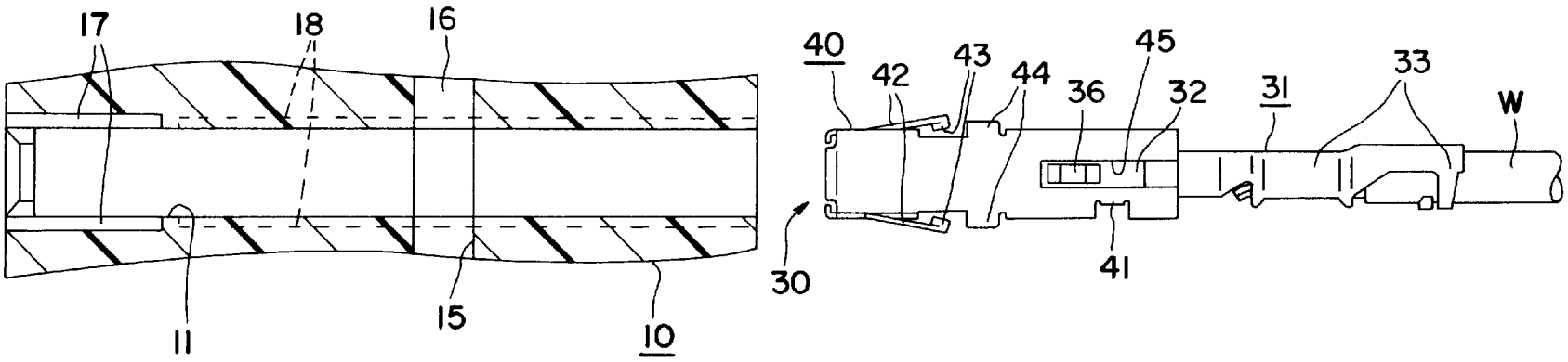
FIG. 2 is a plan view in section showing the female housing before the female terminal fitting is inserted.
Figure 3:
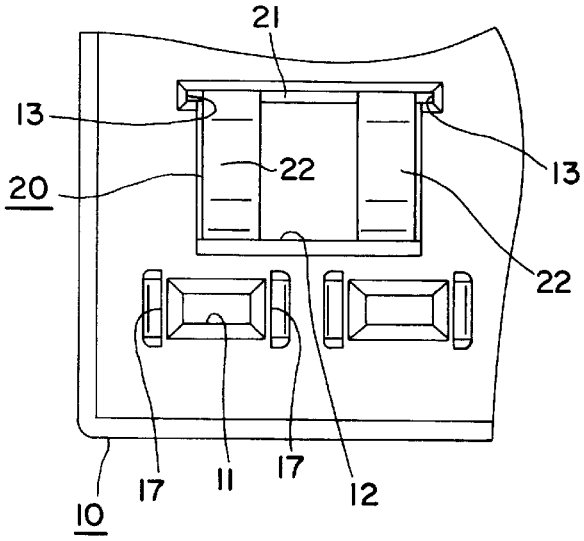
FIG. 3 is a partial front view of the female housing.

As shown in FIGS. 1 and 2, two locking grooves 17 are provided at the front ends of the left and right side surfaces of the cavity 11, and can be engaged with metal locking portions 42 of the female terminal fitting 30. The locking grooves 17 open forwardly, so that a jig for disengaging the metal locking portions 42 can be inserted from the front. Upper and lower insertion grooves 18 are formed behind the locking grooves 17, and are configured to receive stabilizers 44 of the female terminal fitting 30.

The female terminal fitting 30 is formed by integrally securing a cover 40 to a terminal main body 31. The cover 40 is made, for example, of a stainless steel or like material that has a relatively high strength. The terminal main body 31 is made, for example, of a plate material formed from a copper alloy or the like, and preferably has a gold plating applied to its outer surfaces to improve electrical conductivity. This female terminal fitting 30 can be inserted into the cavity 11 either in an erect or inverted orientation, as described in detail later.

Figure 6:
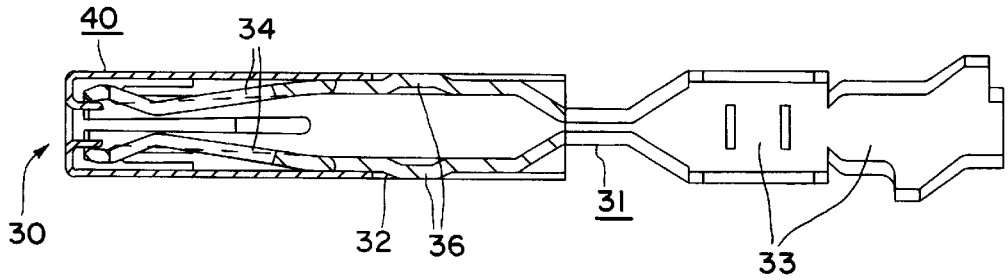
FIG. 6 is a side view in section of the female terminal fitting.

The terminal main body 31 is comprised of a connection portion 32 and a barrel portion 33. The connection portion 32 can be connected with an unillustrated mating male terminal fitting and the barrel portion 33 can be connected with a wire W, preferably by a crimped connection. The connection portion 32 is provided with a pair of tapered elastic contact pieces 34, as shown in FIG. 6. A tab of the male terminal fitting can be inserted into the connection portion 32 from front, and is held in contact between sections of the two contact pieces 34 closer to each other, such that the contact pieces 34 elastically hold or contact the tab.

Figure 5:
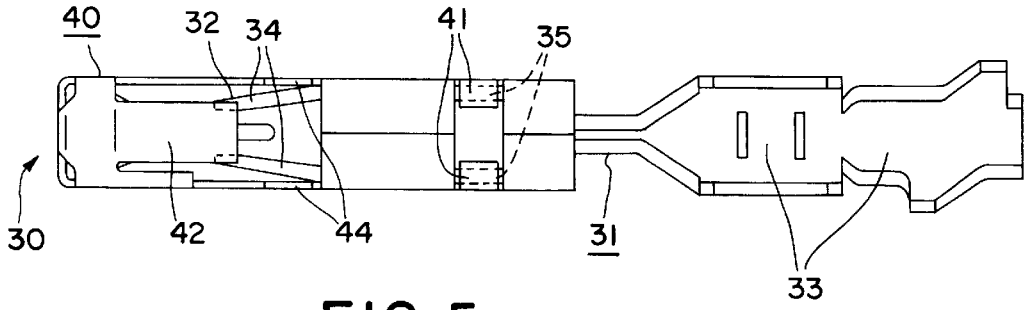
FIG. 5 is a side view of the female terminal fitting.
Figure 8:
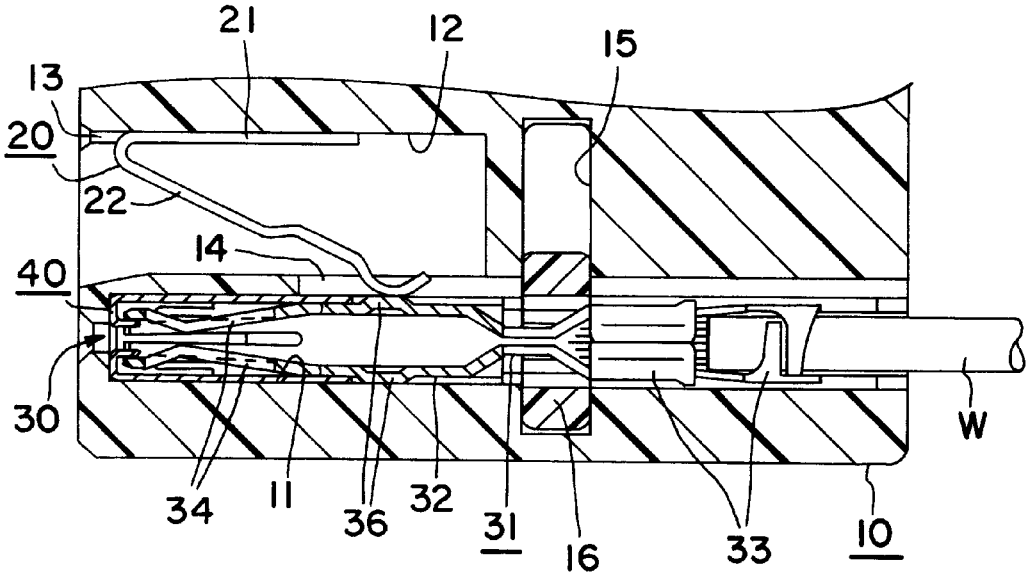
FIG. 8 is a side view in section showing the female terminal fitting inserted into one of the cavities shown in FIG. 3, with a sectional view taken longitudinally through the other cavity being substantially identical.

The cover 40 is substantially box-shaped, and is mounted to cover substantially the entire connection portion 32 of the terminal main body 31. As shown in FIG. 5, a pair of fixing pieces 41 project from the opposite side walls at the rear part of the cover 40, and are bent to substantially surround or to be inserted into or interact with recesses 35 formed in the connection portion 32. Thus, the fixing pieces 41 substantially fix the cover 40 to the terminal main body 31. Further, the retainer 16 can be locked in the cavity 11 by the rear end face of the cover 40, as shown in FIG. 8.

Figure 4:
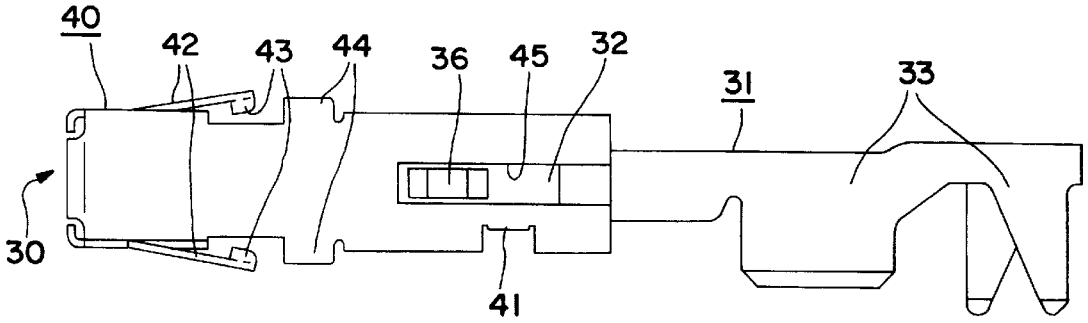
FIG. 4 is a plan view of the female terminal fitting.
Figure 7:
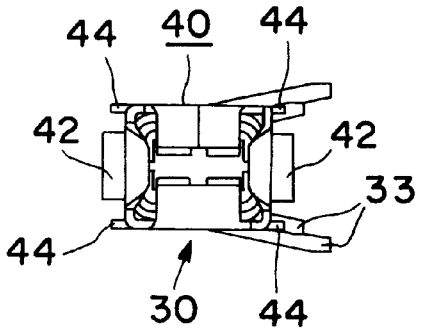
FIG. 7 is a front view of the female terminal fitting,.

As shown in FIG. 4, cuts are made in substantially opposite side walls of the front part of the cover 40 that correspond to the left and right side surfaces of the cavity 11 shown in FIG. 2. The cut portions are bent to form the metal locking portions 42 that project outwardly and that can be deformed substantially elastically inward. Bulging portions 43 are formed to bulge inwardly at the free ends of the metal locking portions 42. The free end surfaces of the metal locking portions 42, including the bulging portions 43, can be engaged with the locking grooves 17 in the cavity 11 to substantially lock the female terminal fitting 30 in the cavity 11. As shown in FIGS. 4, 5 and 7, the stabilizers 44 project laterally outward from the upper and lower walls of the cover 40 at locations behind the metal locking portions 42. The stabilizers 44 are at positions that correspond to the upper and lower surfaces of the cavity 11 shown in FIG. 1. As shown most clearly in FIG. 5, two stabilizers 44 are provided for each metal locking portion 42.

Substantially rectangular or oblong openings 45 are formed in the upper and lower or lateral walls of the rear part of the cover 40 to be open outward, as shown in FIG. 4. These openings 45 also open rearward, and the connection portion 32 of the terminal main body 31 is exposed to the outside through the openings 45. More particular, contact portions 36 of the terminal main body 31 are provided in the exposed portions defined by the openings 45 of the connection portion 32, and can be brought into contact with the contact pieces 22 of the shorting terminal 20.

The contact portions 36 are provided on the upper and lower surfaces of the connection portion 32 which are displaced or angled by substantially 90° from the side surfaces where the metal locking portions 42 are provided. The contact portions 36 are formed e.g. by striking portions of the connection portion 32 to project outward, such that the outer surfaces of the contact portions 36 are substantially flush with the outer surface of the cover 40 as shown in FIG. 6. By providing one contact portion 36 on each of the upper and lower surfaces of the connection portion 32, either one of the contact portions 36 is brought into contact with the contact piece 22 of the shorting terminal 20, regardless of whether the female terminal fitting 30 is inserted into the cavity in its normal erect orientation or in an inverted orientation.

The female terminal fitting 30 is inserted into the cavity 11 of the female housing 10 either in an erect orientation or in an inverted orientation, which is turned 180° from the erect orientation. The female terminal fitting 30 may be inserted into the cavity 11, for example, with the front side of the barrel portion 33 faced in a direction normal of plane of FIG. 1, as shown in FIG. 1.

As the female terminal fitting 30 is inserted further into the cavity 11, the stabilizers 44 are inserted along the insertion grooves 18 and the metal locking portions 42 are deformed elastically inward due to contact with the side surfaces of the cavity 11. The contact piece 22 of the shorting terminal 20 projects into the cavity 11 from the upper surface, and thus is displaced substantially by 90° with respect to the metal locking portions 42 on the side surfaces of the female terminal fitting 30. As a result, neither the contact piece 22 nor the opening 14 is on a path along which the metal locking portion 42 passes. Consequently, the metal locking portions 42 are free from interference with stepped portions at the front ends of the contact piece 22 of the shorting terminal 20 and the opening 14.

When the female terminal fitting 30 is inserted to a proper position, the contact piece 22 of the shorting terminal 20 is brought elastically into contact with the contact portion 36. The contact portion 36 is formed to project outward into the opening 45 of the cover 40. Therefore, the contact piece 22 of the shorting terminal 20 can be brought with sufficient contact pressure directly into contact with the terminal main body 31, which has a good conductivity. Thus the shorting terminal 20 shorts the two female terminal fittings 30 as the female terminal fittings are inserted into the adjacent cavities 11.

Figure 9:
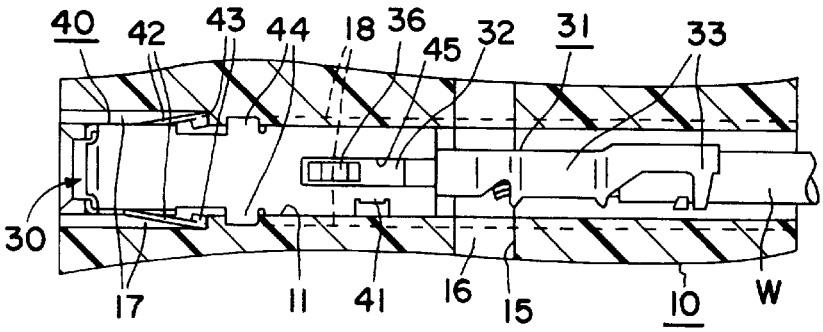
FIG. 9 is a side view showing the female terminal fitting inserted into the cavity.

The metal locking portions 42 are restored elastically toward or substantially to their original shapes upon reaching the locking grooves 17 and their free end surfaces are locked as shown in FIG. 9. As a result, the female terminal fitting 30 is locked in the cavity 11. The female terminal fitting 30 is locked doubly by the retainer 16 that is mounted at least partly in the mount groove 15 to engage the rear end surface of the cover 40.

Figure 10:
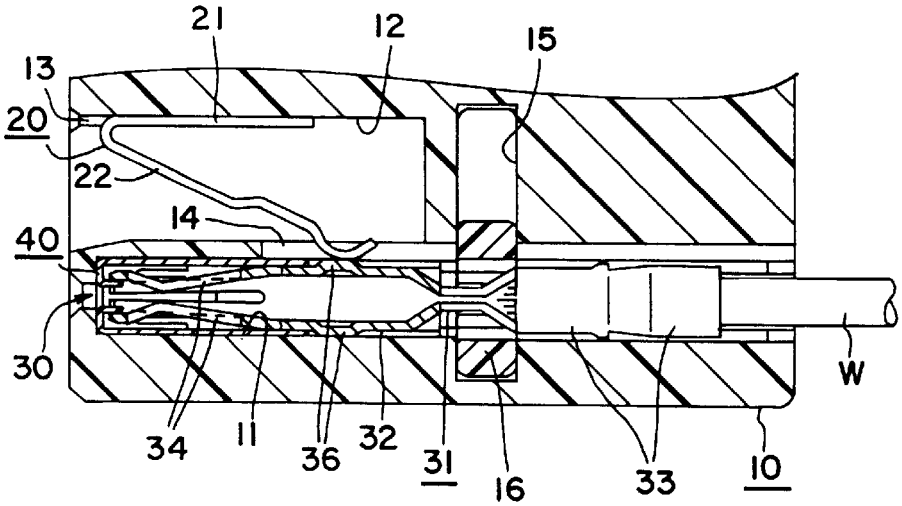
FIG. 10 is a side view in section showing the female terminal fitting inserted into the cavity while being turned upside down from the orientation of FIG. 8.
Figure 11:
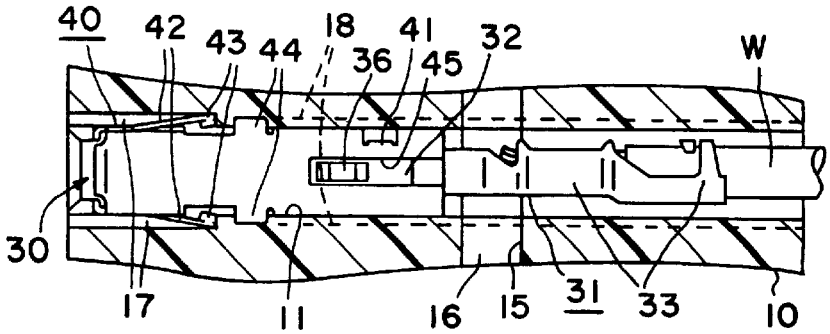
FIG. 11 is a plan view in section showing the female terminal fitting inserted into the cavity shown in FIG. 10.

The female terminal fitting 30 can be inserted into the cavity 11 with its inserting orientation turned by 180° from the above inserting orientation, i.e. with the rear side of the barrel portion 33 facing in the direction normal to the plane of FIG. 10. In this situation, the contact piece 22 of the shorting terminal 20 is brought into contact with the opposite contact portion 36, and the metal locking portions 42 are locked by the locking grooves 17 as shown in FIG. 11. A terminal inserting operation, therefore, can be simplified since the female terminal fitting 30 can be inserted either in an erect orientation or in an inverted orientation. This is particularly effective when the female terminal fitting 30 is small, because it is cumbersome to specify the inserting orientation.

As described above, the shorting terminal 20 is not provided in paths along which the metal locking portions 42 pass when the female terminal fitting 30 is inserted into the cavity 11, thereby preventing the metal locking portions 42 from interference with the shorting terminal 20 and the opening 14.

The present invention is not limited to the above embodiment. For example, following embodiments are also embraced by the technical scope of the invention as defined in the claims. Besides these embodiments, various changes can be made without departing from the scope and spirit of the invention as defined in the claims.

Although the pair of locking grooves are provided in the cavity and the pair of metal locking portions are provided on the female terminal fitting in the foregoing embodiment, only either one of the locking grooves and the metal locking portions may be provided in a pair and only one of the other thereof may be provided when only 180° turning of the inserting orientation of the female terminal fitting is considered. Such an embodiment is also embraced by the present invention.

Although the pair of the metal locking portions are provided on the female terminal fitting in the foregoing embodiment, only one metal locking portion may be provided if it can provide a sufficient locking force.

Although the metal locking portions of the female terminal fitting are locked by the locking grooves formed in the cavity in the foregoing embodiment, the present invention is not limited thereto. For instance, an embodiment in which a resin locking portion provided in the cavity is locked by a locking hole provided in the terminal fitting is also embraced by the present invention.

Although the cover provided with the metal locking portions is secured to the terminal main body in the foregoing embodiment, the metal locking portions may be provided in the terminal main body.

What is claimed is:

1. A terminal fitting for a connector housing, the connector housing having at least one cavity defined by at least one side wall, a contact terminal mounted to the connector housing and substantially facing said side wall of the cavity, the terminal fitting being insertable into the cavity and being brought into contact with the contact terminal upon insertion of the terminal fitting into the cavity, the connector housing further comprising at least one cavity side locking portion in the cavity, the terminal fitting comprising:

one piece terminal main body configured for connection with a mating terminal fitting, contact portions being formed on oppositely facing surfaces of the terminal main body, the contact portions being dimensioned and disposed for contacting the contact terminal upon insertion of the terminal fitting into the cavity;

a cover integrally fitted on the terminal main body, the cover being formed with openings exposing the contact portions of the terminal main body, at least one terminal side locking portion on an outer surface of the terminal fitting projecting outwardly on the cover and being displaced from said contact portions by substantially 90°, the terminal side locking portion being engageable with the cavity side locking portion in the cavity, at least one of the terminal side locking portion and the cavity side locking portion being provided as a pair, such that the terminal fitting can be locked in the cavity in either of a first orientation and a second orientation.

2. A terminal fitting according to claim 1, wherein the contact portions are formed on the outer surfaces of the terminal main body to project outward.

3. A connector comprising:

a connector housing having at least one cavity extending therethrough, at least one cavity side locking portion being provided in the cavity;

a contact terminal disposed in the connector housing and communicating with the cavity; and at least one cavity side locking portion for engaging, a terminal fitting accommodated in the cavity, the terminal fitting having one piece terminal main body formed with contact portions facing outwardly on oppositely facing surfaces of the terminal main body, a cover integrally fitted on the terminal main body, the cover being formed with openings exposing the contact portions of the terminal main body, at least one terminal side locking portion provided on an outer surface of the cover, at least one of the terminal side locking portion and the cavity side locking portion being provided as a pair, such that the terminal fitting can be locked in the cavity in either of a first orientation and a second orientation.

4. A terminal fitting comprising:

one piece terminal main body having opposed front and rear ends, the front end comprising at least one contact piece configured for engagement with a mating terminal fitting, the rear end defining a barrel for engagement with a wire, a pair of opposed contact portions projecting outwardly on portions of said terminal main body between said opposed front and rear ends; and a cover formed around portions of said terminal main body extending rearwardly from the front end of said terminal main body, the cover comprising a pair of outwardly projecting locking portions disposed at locations offset by 90° from said contact portions of said terminal main body, the cover further having openings disposed at locations that permit the contact portions of the terminal main body to project into said openings.

5. The terminal fitting of claim 4, wherein the cover is formed from a first metal material, and wherein the terminal main body is formed from a second metal material, the first metal material exhibiting greater strength than the second metal material.

6. The terminal of claim 5, wherein the first metal material is stainless steel.

7. The terminal of claim 5, wherein the second metal material is a copper alloy.

8. A connector comprising:

a housing having first and second cavities extending therethrough and an accommodating chamber, openings defined in said housing for communication between said cavities and said accommodating chamber, each said cavity having at least one locking portion offset from the opening by substantially 90°;

a shorting terminal mounted in the accommodating chamber, the shorting terminal having first and second contact pieces extending through the respective openings and into the respective first and second cavities;

first and second terminal fittings insertable into said first and second cavities, each said terminal fitting having a pair of outwardly projecting locking projections, each said locking projection being disposed for locked engagement with the locking portion in each of said cavities, each said terminal fitting further comprising a pair of opposed outwardly projecting contact portions at locations on the respective terminal fitting offset from said locking projections by 90°, each said contact portion being configured for engagement with one of the first and second contact pieces of the shorting terminal projecting into the respective cavity, whereby each said terminal fitting can be inserted into the respective cavity in an erect orientation and in an inverted orientation while still permitting one of said locking projections to lockingly engage the locking portion and enabling one said contact portion to contact the contact piece projecting into the respective cavity, the terminal fitting comprising a cover and one piece terminal main body formed from separate materials, said locking portions being formed on the cover and the contact portions being formed on the terminal main body, the cover further being formed with openings disposed for exposing the contact portions.

9. The connector of claim 8, wherein the housing includes an opening extending into communication with each of said cavities, the connector further comprising a retainer extending into the opening for locked engagement with the cover of the terminal fitting, whereby the locking projections and the retainer redundantly lock the terminal fittings in the respective cavities.

10. The connector of claim 8, wherein the cover of the terminal fitting is formed from a metal material exhibiting greater strength than the terminal main body.

11. The connector of claim 10, wherein the terminal main body is formed from a metal material exhibiting better conductivity than the cover.

* * * * *